US006727469B1

(12) United States Patent
Parker et al.

(10) Patent No.: US 6,727,469 B1
(45) Date of Patent: Apr. 27, 2004

(54) HEATED BOOTY

(76) Inventors: April F. Parker, 10400 John Price Rd. Lot 133, Charolette, NC (US) 28273; Kevin L. Jenkins, 626 Archdale Dr., Apt. D, Charolette, NC (US) 28217

( * ) Notice: Subject to any disclaimer, the term of this patent is extended or adjusted under 35 U.S.C. 154(b) by 0 days.

(21) Appl. No.: 10/301,305

(22) Filed: Nov. 22, 2002

(51) Int. Cl.[7] ..... H05B 1/00; H05B 3/00
(52) U.S. Cl. ..... 219/211; 36/2.6
(58) Field of Search ..... 219/523, 528, 219/211, 387, 549, 530, 540; 36/2.6; 607/111, 114; 126/263.01; 392/339, 346

(56) References Cited

U.S. PATENT DOCUMENTS

| | | | | | |
|---|---|---|---|---|---|
| 3,663,796 | A | * | 5/1972 | Hines et al. | 219/211 |
| 3,751,620 | A | * | 8/1973 | Yuasa | 219/211 |
| 3,867,611 | A | * | 2/1975 | Riley et al. | 219/523 |
| 4,042,803 | A | | 8/1977 | Brickford | |
| 4,404,460 | A | * | 9/1983 | Kerr | 219/211 |
| 4,665,308 | A | | 5/1987 | Courvoisier | |
| 4,777,344 | A | * | 10/1988 | Nash et al. | 219/211 |
| 4,845,338 | A | * | 7/1989 | Lakic | 219/211 |
| 4,862,603 | A | * | 9/1989 | Balbinot | 36/2.6 |
| 4,894,931 | A | * | 1/1990 | Senee et al. | 36/2.6 |
| 4,910,881 | A | * | 3/1990 | Baggio et al. | 36/2.6 |
| 4,948,951 | A | * | 8/1990 | Balzano | 219/528 |
| 5,032,705 | A | * | 7/1991 | Batcheller et al. | 219/211 |
| 5,041,717 | A | * | 8/1991 | Shay, III et al. | 219/211 |
| 5,050,595 | A | | 9/1991 | Krafft | |
| 5,148,002 | A | * | 9/1992 | Kuo et al. | 219/211 |
| 5,486,680 | A | | 1/1996 | Lieberman | |
| 5,623,772 | A | * | 4/1997 | Sunderland et al. | 36/2.6 |
| 6,012,726 | A | * | 1/2000 | Grande et al. | 280/11.22 |
| 6,268,595 | B1 | * | 7/2001 | Haenel | 219/528 |
| 6,329,644 | B1 | * | 12/2001 | Hyatt | 219/528 |
| 6,416,534 | B1 | * | 7/2002 | Montagnino et al. | 607/114 |
| 6,555,789 | B2 | * | 4/2003 | Owens et al. | 219/387 |
| 6,576,003 | B2 | * | 6/2003 | Kotack | 607/111 |

FOREIGN PATENT DOCUMENTS

| | | | | |
|---|---|---|---|---|
| DE | 3616326 | * | 11/1987 | A43B/7/02 |

* cited by examiner

*Primary Examiner*—Ehud Gartenberg
*Assistant Examiner*—L Fastovsky

(57) ABSTRACT

A heated booty for heating or cooling the foot of a wearer of the booty includes a booty having a foot portion and an ankle portion. The booty includes an outer layer separated from an inner layer such that a chamber is defined between the inner and outer layers. A gel pack is positioned in the chamber. A plurality of heating elements is positioned in and extends through the gel pack. A control for selectively turning the heating elements on or off is electrically coupled to the heating elements and is mounted on the booty.

5 Claims, 2 Drawing Sheets

HEATED BOOTY

BACKGROUND OF THE INVENTION

1. Field of the Invention

The present invention relates to heated booty and more particularly pertains to a new heated booty for heating or cooling the foot of a wearer of the booty.

2. Description of the Prior Art

The use of heated booties is known in the prior art. U.S. Pat. No. 4,665,308 describes a booty having heating elements therein for heating the booty, and a foot therein. Another type of heated booty is U.S. Pat. No. 5,486,680 which generally describes a heating system for gloved, socks and the like. Other relevant patents include U.S. Pat. No. 4,042,803 and U.S. Pat. No. 5,050,595.

While these devices fulfill their respective, particular objectives and requirements, the need remains for a device that includes gel which can either be heated with heating elements or cooled by placing in a refrigerator.

SUMMARY OF THE INVENTION

The present invention meets the needs presented above by including a booty with gel therein such that the booty may be positioned in a refrigerator and the gel cooled. When placed upon a foot, the gel will thus cool the foot.

Still yet another object of the present invention is to provide a new heated booty that includes heating elements for heating gel within the booty. The heated gel thereby heats a foot when the booty is positioned on a foot.

To this end, the present invention generally comprises a booty having a foot portion and an ankle portion. The booty includes an outer layer separated from an inner layer such that a chamber is defined between the inner and outer layers. A gel pack is positioned in the chamber. A plurality of heating elements is positioned in and extends through the gel pack. A control for selectively turning the heating elements on or off is electrically coupled to the heating elements and is mounted on the booty.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
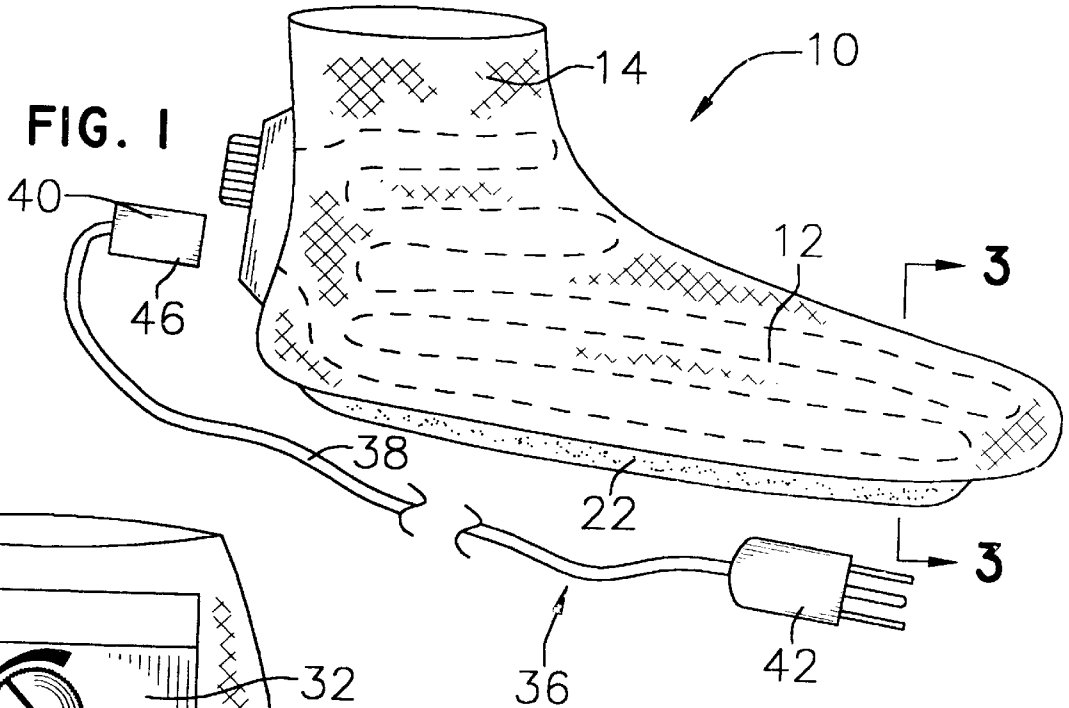
FIG. 1 is a schematic side view of a heated booty according to the present invention.
Figure 2:
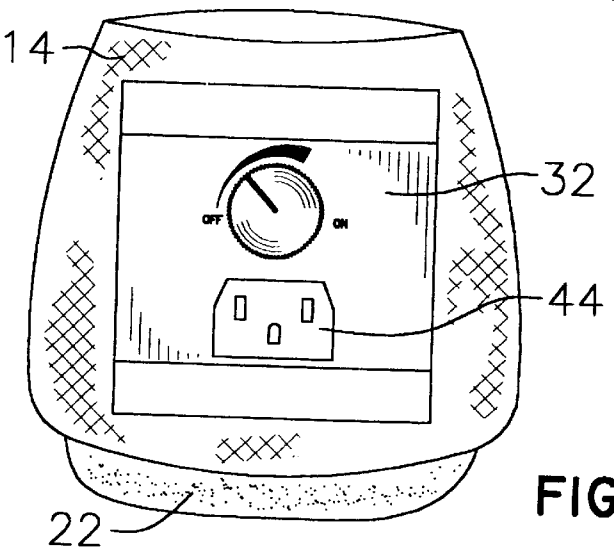
FIG. 2 is a schematic back view of the present invention.
Figure 3:
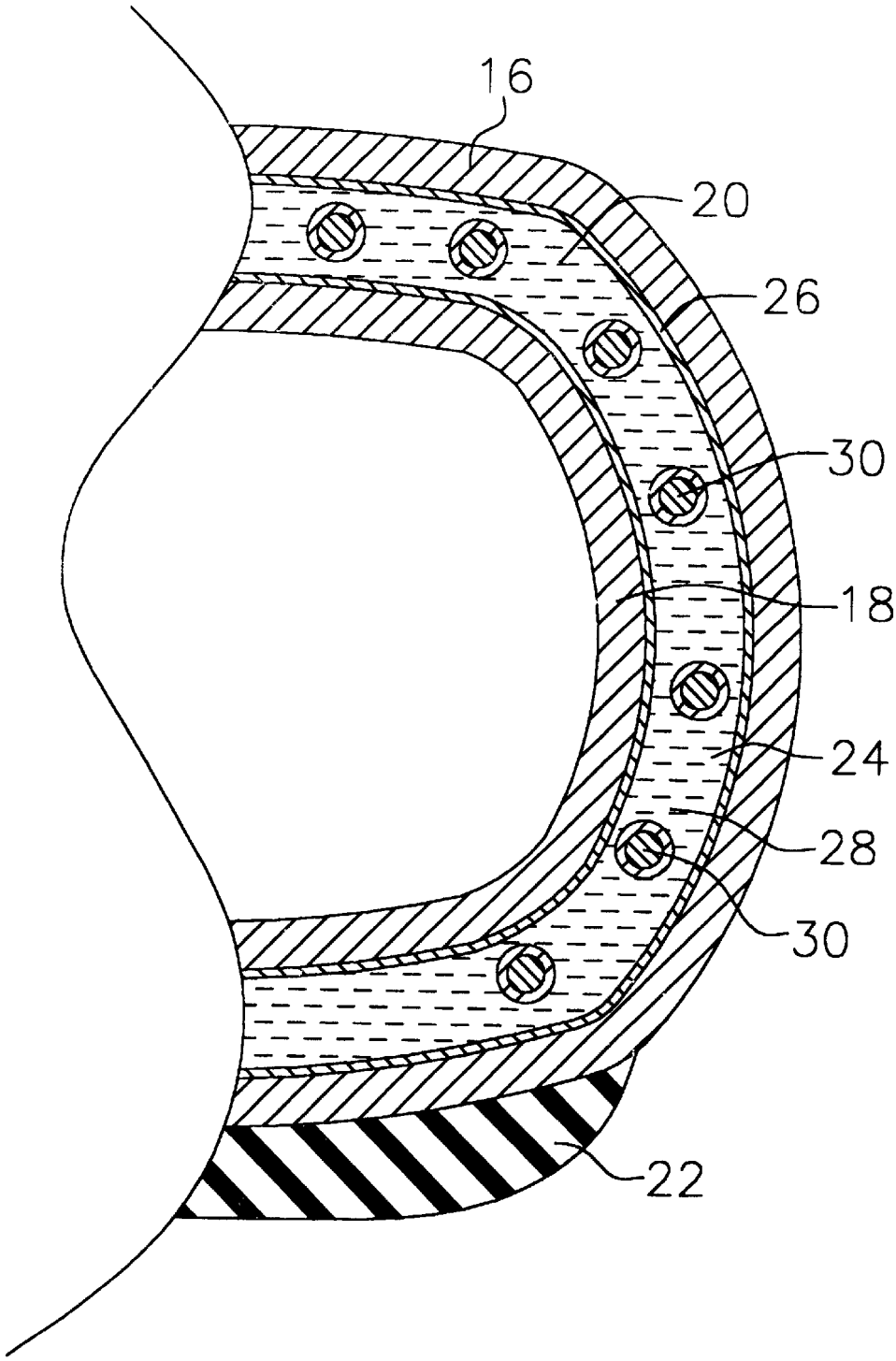
FIG. 3 is a schematic cross-sectional view taken along line 3—3 of FIG. 1 of the present invention.

With reference now to the drawings, and in particular to FIGS. 1 through 3 thereof, a new heated booty embodying the principles and concepts of the present invention and generally designated by the reference numeral 10 will be described.

As best illustrated in FIGS. 1 through 3, heated booty 10 generally comprises a booty having a foot portion 12 and an ankle portion 14. The booty 10 includes an outer layer 16 separated from an inner layer 18 such that a chamber 20 is defined between the inner 18 and outer 16 layers. The booty 10 preferably comprises a cloth material such as cotton. A sole 22 may be attached to a bottom surface of the booty.

A gel pack 24 is positioned in the chamber 20. The gel pack 24 substantially fills the chamber 20. The gel pack 24 comprises a sealed elastomeric container 26 generally having the same shape as the booty. A gel 28 substantially fills the container.

A plurality of heating elements 30 is positioned in and extends through the gel pack 24. A control 32 for selectively turning the heating elements 30 on or off is electrically coupled to the heating elements 30 and is mounted on the booty 10. The control 32 is ideally located on an ankle portion 14 of the booty 10. The control 32 is adapted for selectively increasing or decreasing an amount of electricity supplied to the heating elements 34. The control 32 includes a dial for selecting between high and low temperatures.

A power supply 36 is removably coupled to the control 32. The power supply 36 includes a cord 38 has a first end 40 and a second end 42 and a receiving member 44 electrically coupled to the control 32. The first end 40 of the cord 38 is preferably a female coupler 46, which is frictionally couplable to the receiving member 44.

In use, the booty 10 is placed on the foot and electricity supplied to the heating elements 30. The heating elements 30 heat the gel 28. The gel 28 retains the heat for an extended amount of time after the electricity is turned off. The booty 10 may be worn within shoes or boots, or by itself indoors.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A heated booty comprising:

a booty having a foot portion and an ankle portion, said booty including an outer layer separated from an inner layer, said booty comprising a cloth material;

a gel pack being positioned between said inner and outer layers of said booty, said gel pack comprising a sealed elastomeric container generally having the same shape as said booty;

a plurality of heating elements being positioned in and extending through said gel pack; and a control for selectively turning said heating elements on or off being electrically coupled to said heating elements and being mounted on said booty.

2. The heated booty as in claim 1, wherein said control is located on an ankle portion of said booty.

3. The heated booty as in claim 1, wherein said control is adapted for selectively increasing or decreasing an amount of electricity supplied to said heating elements.

4. The heated booty as in claim 1, wherein said power supply includes a cord having a first end and a second end, and a receiving member electrically coupled to said control, said first end of said cord being frictionally couplable to said receiving member.

5. A heated booty comprising:

a booty having a foot portion and an ankle portion, said booty including an outer layer separated from an inner layer such that a chamber is defined between said inner and outer layers, said booty comprising a cloth material;

a gel pack being positioned in said chamber, said gel pack substantially filling said chamber, said gel pack comprising a sealed elastomeric container generally having the same shape as said booty, a gel substantially filling said container;

a plurality of heating elements being positioned in and extending through said gel pack;

a control for selectively turning said heating elements on or off being electrically coupled to said heating elements and being mounted on said booty, said control being located on an ankle portion of said booty, said control being adapted for selectively increasing or decreasing an amount of electricity supplied to said heating elements;

a power supply being removably coupled to said control, said power supply including a cord having a first end and a second end and a receiving member electrically coupled to said control, said first end of said cord being frictionally couplable to said receiving member; and a sole being attached to a bottom surface of said booty.

* * * * *